United States Patent [19]

Peters

[11] Patent Number: 4,520,526

[45] Date of Patent: Jun. 4, 1985

[54] RESILIENTLY FLEXIBLE TOOTHBRUSH

[76] Inventor: Charles W. Peters, 1498 Padres Dr., San Jose, Calif. 95125

[21] Appl. No.: 623,107

[22] Filed: Jun. 22, 1984

[51] Int. Cl.[3] ..... A46B 9/04

[52] U.S. Cl. ..... 15/167 R; 15/143 R; 15/201; 15/172

[58] Field of Search ..... 15/143 R, 167 R, 167 A, 15/201, 160, 186, 187, 188 R, 172

[56] References Cited

U.S. PATENT DOCUMENTS

| | | | |
|---|---|---|---|
| 128,840 | 7/1872 | Allerton | 15/188 |
| 1,327,807 | 1/1920 | Burleigh | 15/167 R X |
| 1,796,001 | 3/1931 | Church | 15/167 R |
| 2,445,657 | 7/1948 | Bennet | 15/167 R |
| 2,631,320 | 3/1953 | Bressler | 15/201 |
| 4,263,691 | 4/1981 | Pakarwseree | 15/167 R X |

FOREIGN PATENT DOCUMENTS

| | | | |
|---|---|---|---|
| 476479 | 12/1937 | United Kingdom | 15/167 R |

*Primary Examiner*—Peter Feluman

*Attorney, Agent, or Firm*—Claude A. S. Hamrick

[57] ABSTRACT

A brush having a shaped body member with a handle portion, a head portion and a flexible portion. The flexible portion allows the head portion to move relative to the handle portion in the vertical plane, but is substantially rigid in the horizontal plane.

3 Claims, 5 Drawing Figures

RESILIENTLY FLEXIBLE TOOTHBRUSH

BACKGROUND OF THE INVENTION

1. Field of the Invention

This invention relates to brushes that have flexible handles. In particular this invention relates to toothbrushes that have flexible handles to prevent the application of excessive pressure to the teeth and gums.

2. Description of the Prior Art

The importance of proper thorough cleaning of the teeth is well known, as are the problems associated with achieving such cleanliness. A popular recommended action for cleaning the teeth is brushing downwardly from the gums or, more preferably, wriggling the brush with the ends of the brush in contact with the teeth. The second method is more effective at removing particles of food debris that may accumulate in the spaces between the teeth. One problem with conventional brushes is that the stiff bristles, even those identified as soft, can lead to abrasion of both the tooth material (enamel, cementum and dentin) and the gum tissue if excessive force is applied. The problem of abrasion is general any time a delicate surface is cleaned by a brush.

The most common conventional solution is softening the bristles. Other approaches have been used. U.S. Pat. No. 4,263,691 to Pakarnseree discloses a toothbrush having bristles that are resilient but covered with soft elastomer to prevent damage to the teeth and gums. U.S. Pat. No. 4,333,199 to Del Rosario discloses a toothbrush head that pivots. The head and bristles are separately molded from and mounted on the handle, which is rigid and reinforced.

U.S. Pat. No. 4,330,896 to Booth discloses a toothbrush that has a partially pivoting head. It is secured to the handle by two pivot points.

A head that is part of an integrally molded body that pivots in the vertical plane is not shown.

SUMMARY OF THE PRESENT INVENTION

An object of this invention is to provide a brush that bends noticably in response to excessive pressure to avoid damaging delicate articles being brushed, but provides sufficient pressure to clean these articles.

A further object of this invention is to provide a toothbrush that bends in response to excessive pressure to avoid damaging tooth material (enamel, cementum and dentin) and gum tissue but provides sufficient pressure to clean the teeth and gums.

The present invention provides a brush that is flexible in the vertical plane. The brush has a shaped body having a handle portion, a head portion and a flexible portion between the handle portion and the head portion. The head portion has attached bristles. The head portion flexes in a vertical plane relative to the handle portion when excessive force is applied to the handle portion.

IN THE DRAWING

FIG. 1 shows a perspective view of the brush of the present invention;

FIG. 1*a* shows a perspective view of an alternative embodiment of the brush of the present invention;

DETAILED DESCRIPTION OF THE PREFERRED EMBODIMENT

Figure 1:
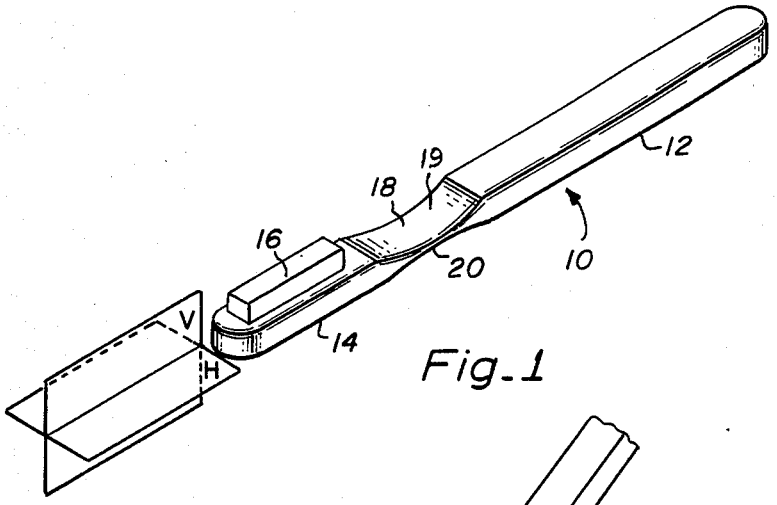

Referring to FIG. 1, a brush has a molded body 10 which includes a handle portion 12 and a head portion 14. The head portion has attached bristles 16. The handle portion and head portion are separated by a resiliently flexible portion 18. The head portion can flex relative to the handle portion in the vertical plane, identified as V in the drawing, but is substantially rigid in the horizontal plane, identified as H in the drawing. If the resistance of the handle to bending is chosen with care, the handle will bend rather than causing the bristles to excessively distort. In this way, the bristles will maintain a substantially perpendicular relationship to the handle, resulting in improved cleaning properties.

Figure 1A:
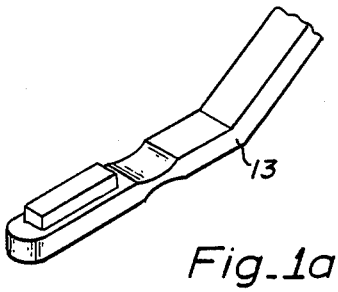

Referring to FIG. 1*a*, any shape handle may be used. For example, a handle with a permanent bend in the vertical plane 13, which is a popular shape for toothbrush use, may be used. The flexible joint could be on either side of the bend in the handle.

Figure 2:
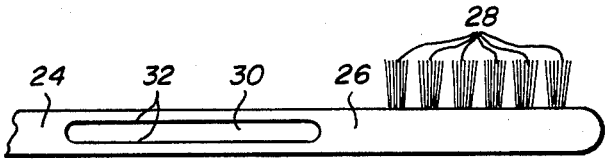
FIG. 2 shows a side view of an alternative embodiment of the brush of the present invention.

The flexible joint is not limited to thinnings of the body member of the brush by removing part of the material from the top portion 19 of the body portion and part of the material of the bottom portion 20 of the body portion. Referring to FIG. 2, an alternative embodiment has a shaped hollow in the body member 22 which extends horizontally throughout from one side to the other. The body member 22 has a handle portion 24 and a head portion 26 having attached bristles 28. The flexible portion has a molded or shaped hollow 30 in the body member attaching the handle portion to the head portion by flexible members 32.

Figure 3:
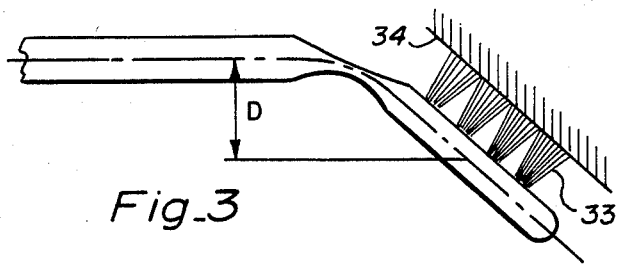
FIG. 3 shows a side view of the brush of FIG. 1 flexed position.

When a delicate object is brushed, the head portion flexes relative to the handle portion in the vertical plane if excessive pressure is applied. Referring to FIG. 3, when a surface 34 is brushed by a brush 33, the center of the head of the brush 33 is deflected by an amount D, an amount herein defined as the deflection.

Figure 4:
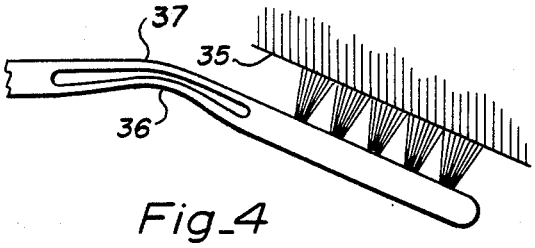
FIG. 4 shows a side view of the brush of FIG. 2 in a flexed position.

Referring to FIG. 4 the flexible members of the brush of FIG. 2 bend allowing the head portion to flex. The surface 35 being brushed is protected from excessive pressure. A characteristic of this embodiment is the inward flexure of the inside flexible member 36 against the top member 37.

A series of conventional toothbrushes made of polypropylene were modified to be toothbrushes of the present invention by removing an amount of the body member material from the top and bottom as in FIG. 1 or modified to have hollow handles as in FIG. 2. The flexible joints were all about 1/16 of an inch thick. The middle of the head of the brushes was deflected an amount D by loading masses on the center of the head. The results are tabulated in Table 1.

TABLE 1

| | Brush | Amount of D | | | | |
|---|---|---|---|---|---|---|
| Brush # | Configuration | ⅛" | ¼" | ½" | ¾" | 1" |
| Brush 1 | Removal | 70 g | 110 g | 200 g | 300 g | 300 g |
| Brush 2 | of Material | 70 g | 110 g | 240 g | 310 g | 450 g |
| Brush 3 | from Top and | 80 g | 160 g | 240 g | 300 g | 300 g |
| Brush 4 | Bottom | | 200 g | 280 g | 370 g | 500 g |
| Brush 5 | | | 300 g | 400 g | 480 g | 600 g |
| Brush 6 | Hollow Handle | | 250 g | 350 g | 350 g | |
| Brush 7 | | | 250 g | 400 g | 500 g | 600 g |
| Brush 8 | Unmoified | 500 g | | | | |

The numbers in the body of Table 1 refer to the mass required to deflect the head the amount D. The preferred resistance is in the range of 150–400 grams for ½" deflection, 100–300 grams for ¼" deflection and 300–500 grams for ¾" deflection. Brushes 1 to 7 all meet these criteria. Brushes were tested and it was found that this range of pressure felt best and the bristles interacted with the teeth and gums best.

The deflection is measured by a distance but can also be measured as an angle. For the typical toothbrush, the deflection dimensions (D) of ¼ inch, ½ inch and ¾ inch would be approximately 10 degrees, 20 degrees and 30 degrees, respectively.

The force may also be measured in relation to the bending or distorting of the bristles. Some bending and contour fitting of the bristle ends to the irregular surface of the teeth and the space between the teeth and gums is necessary. Excessive bending of the bristles once contact is made with the surface being cleaned causes unnecessary wear.

In use as a tooth brush the user would apply force to the brush to clean the teeth and gums, but, as the amount of pressure increased, the increased amount of bending would warn the user to reduce the pressure. In this manner, the teeth and gums are protected from wear by excessive pressure while sifficient pressure is available to clean the teeth and gums.

As will be clear to those skilled in the art, modifications and changes may be made to the disclosed embodiments without departing from the inventive concepts thereof. The above description is intended to be illustrative and informative, but not limiting in scope. Accordingly, it is intended that the following claims be interpreted to cover all modifications that reasonably fall within the scope of the invention.

What is claimed is:

1. A tooth brush comprising:

a shaped body member having a handle portion, a head portion and a resiliently flexible portion therebetween, the head portion having attached bristles, the resiliently flexible portion being flexible in a vertical plane allowing the head portion movement relative to the handle portion, but substantially rigid in a horizontal plane, the bristles extending upwardly in the vertical direction, wherein said body member has a shaped hollow at the resiliently flexible portion, creating a thin top resiliently flexible horizontal member and a thin bottom resiliently flexible horizontal member, said shaped hollow extending completely through said resiliently flexible portion from one side to the other side thereof in the horizontal direction, and wherein the middle of the head portion can be deflected in the ¼" to ¾" range with a force just sufficient to bring the bristle ends in good contact to the irregular surfaces of the teeth and gums.

2. The tooth brush of claim 1 wherein the middle of the head portion can be deflected ¼" by application of a mass in the range of 100–300 grams, ½" by application of a mass in the range of 150 to 400 grams and ¾" by application of a mass in the range of 250–500 grams.

3. The tooth brush of claim 1 wherein the middle of the head portion can be deflected approximately 10 degrees by application of a mass in the range of 100–300 grams, approximately 20 degrees by application of a mass in the range of 150 to 400 grams and approximately 30 degrees by application of a mass in the range of 250–500 grams.

* * * * *